US010386766B2

(12) United States Patent
Sakamaki

(10) Patent No.: US 10,386,766 B2
(45) Date of Patent: Aug. 20, 2019

(54) IMAGE FORMING APPARATUS AND FEED CONTROL METHOD

(71) Applicant: Konica Minolta, Inc., Chiyoda-ku, Tokyo (JP)

(72) Inventor: Tsutomu Sakamaki, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 79 days.

(21) Appl. No.: 15/438,288

(22) Filed: Feb. 21, 2017

(65) Prior Publication Data

US 2017/0269528 A1 Sep. 21, 2017

(30) Foreign Application Priority Data

Mar. 18, 2016 (JP) ..... 2016-055153

(51) Int. Cl.
*G03G 15/00* (2006.01)
*G03G 15/20* (2006.01)

(52) U.S. Cl.
CPC ..... *G03G 15/5029* (2013.01); *G03G 15/206* (2013.01); *G03G 15/2028* (2013.01); *G03G 15/657* (2013.01); *G03G 2215/00679* (2013.01)

(58) Field of Classification Search
CPC ..... G03G 15/2085; G03G 15/6529; G03G 15/657; G03G 15/2089; B65H 9/10; B65H 9/101; B65H 9/16; B65H 29/70
See application file for complete search history.

(56) References Cited

U.S. PATENT DOCUMENTS

2002/0093558 A1* 7/2002 Hauptmann ..... G03G 15/2007 347/104
2009/0245819 A1* 10/2009 Shiobara ..... G03G 15/657 399/16

FOREIGN PATENT DOCUMENTS

JP 2006-267375 A 10/2006

* cited by examiner

*Primary Examiner* — Leslie J Evanisko
*Assistant Examiner* — Quang X Nguyen
(74) *Attorney, Agent, or Firm* — Squire Patton Boggs (US) LLP

(57) ABSTRACT

An image forming apparatus includes: a transfer unit configured to transfer a toner image to a recording medium at a transfer nip; a fuser unit configured to heat and pressurize at a fuser nip the recording medium to which the toner image has been transferred by the transfer unit, to fuse the toner image to the recording medium; and a pressing unit configured to press both edge portions of the recording medium in a width direction between the transfer nip and the fuser nip so that a central portion of the recording medium in the width direction becomes lower than the both edge portions of the recording medium in the width direction.

15 Claims, 8 Drawing Sheets

IMAGE FORMING APPARATUS AND FEED CONTROL METHOD

The entire disclosure of Japanese Patent Application No. 2016-055153 filed on Mar. 18, 2016 including description, claims, drawings, and abstract are incorporated herein by reference in its entirety.

BACKGROUND OF THE INVENTION

Field of the Invention

The present invention relates to an image forming apparatus and a feed control method.

Description of the Related Art

Image forming apparatuses using electrophotographic process technology (such as printers, copiers, and facsimiles) form an electrostatic latent image typically by irradiating (exposing) a charged photoconductor with (to) laser light based on image data. Then, the electrostatic latent image is visualized by supplying toner from a developing device to a photoconductor drum (image carrier) on which the electrostatic latent image has been formed to form a toner image. The toner image is further transferred directly or indirectly to a sheet, and then heated and pressurized by a fuser nip to be fused, and thereby to form a toner image on the sheet.

When a misalignment occurs between a transfer nip and a fuser nip, or when a difference in feed speed arises between the front side and the back side in the fuser nip in the width direction, a difference in feed state arises between both edge portions of a sheet in the width direction. FIG. 1A is a perspective view illustrating a sheet when a difference in feed state arises between its both edge portions in the width direction. FIG. 1B is a perspective view illustrating a sheet when slack occurs in a sheet feed direction. FIG. 2 is a diagram illustrating a state where a sheet having increased slack in a feed direction contacts a peripheral member.

When a difference in feed speed arises between the front side and the back side in a fuser nip in the width direction as illustrated in FIG. 1A, for example, there arises a problem that slack occurs in the feed direction in a sheet that has entered the fuser nip as illustrated in FIG. 1B. In particular, for a sheet such as long paper elongated in the feed direction, difference in speed between the front side and the back side tends to accumulate, increasing slack in the sheet in the feed direction.

When slack in a sheet S in a feed direction is increased, as illustrated in FIG. 2, the sheet S contacts a peripheral member such as an upper guide 60C located at the front of a fuser nip in a fuser 60 that houses a fuser roller 63 and a pressure roller 64. A contacting-side surface of the sheet S is an image forming surface. Thus an unfused image forming surface before entering the fuser nip contacts the peripheral member, causing an image defect. Even when a slack portion in the sheet S does not contact the peripheral member, the rear end of the sheet S may contact the peripheral member, causing an image defect because the rear end of the sheet springs up when released from the transfer nip.

JP 2006-267375 A discloses a configuration in which an entry guide disposed at the front of a fuser nip is moved to press a central portion of a sheet in a width direction. The configuration described in JP 2006-267375 A, however, cannot solve the above problem because when slack occurs in a sheet in a feed direction as illustrated in FIG. 1B, the entry guide does not contact a slack portion.

SUMMARY OF THE INVENTION

An object of the present invention is to provide an image forming apparatus and a feed control method capable of preventing occurrence of an image defect due to slack in a recording medium in a feed direction.

To achieve the abovementioned object, according to an aspect, an image forming apparatus reflecting one aspect of the present invention comprises:

a transfer unit configured to transfer a toner image to a recording medium at a transfer nip;

a fuser unit configured to heat and pressurize at a fuser nip the recording medium to which the toner image has been transferred by the transfer unit, to fuse the toner image to the recording medium; and a pressing unit configured to press both edge portions of the recording medium in a width direction between the transfer nip and the fuser nip so that a central portion of the recording medium in the width direction becomes lower than the both edge portions of the recording medium in the width direction.

To achieve the abovementioned object, according to an aspect, there is provided a feed control method for an image forming apparatus comprising a transfer unit configured to transfer a toner image to a recording medium at a transfer nip, and a fuser unit configured to heat and pressurize at a fuser nip the recording medium to which the toner image has been transferred by the transfer unit, to fuse the toner image to the recording medium, and the method reflecting one aspect of the present invention comprises:

pressing both edge portions of the recording medium in a width direction between the transfer nip and the fuser nip so that a central portion of the recording medium in the width direction becomes lower than the both edge portions of the recording medium in the width direction.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 3:
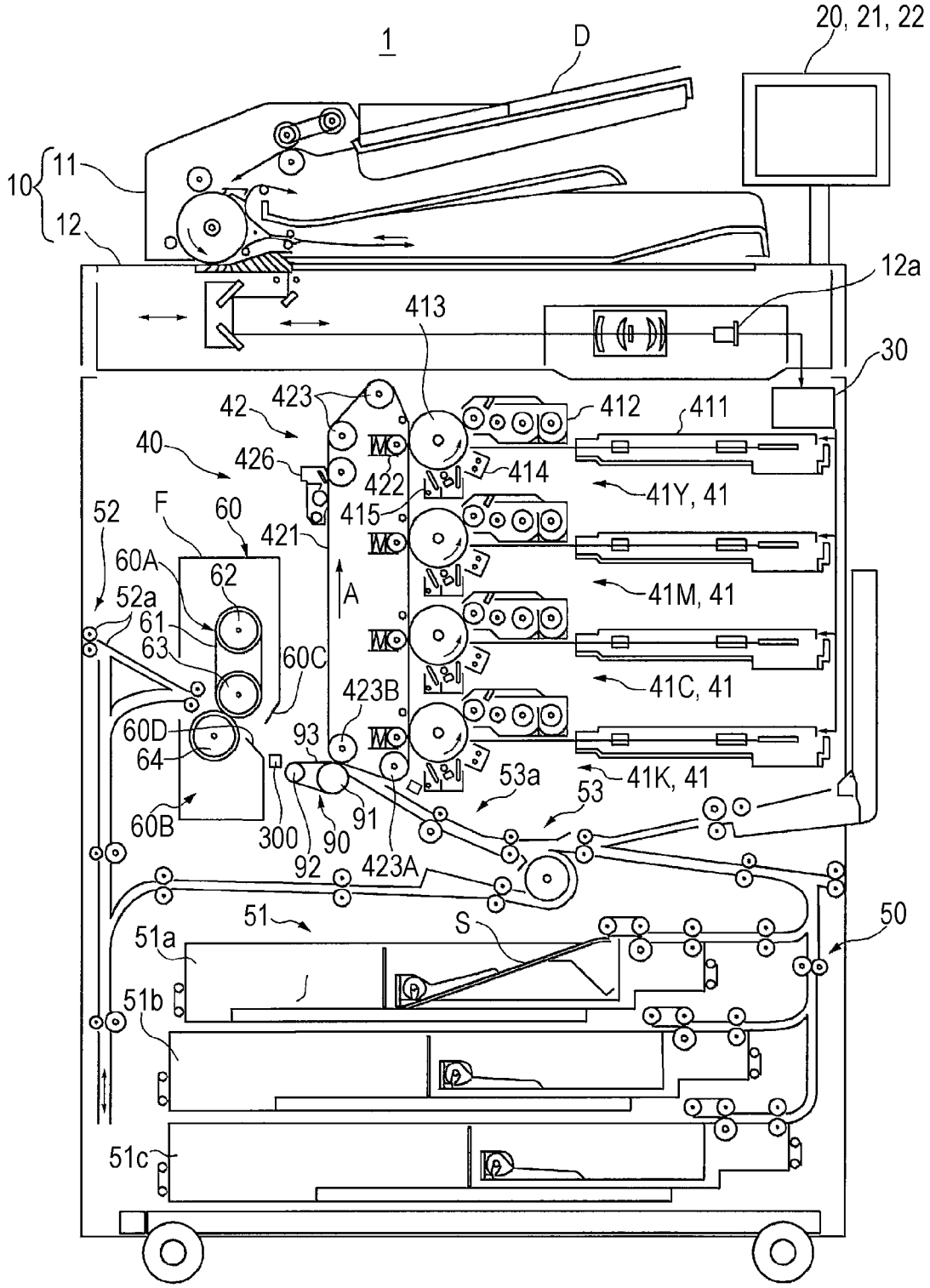
FIG. 3 is a diagram illustrating the entire configuration of an image forming apparatus according to an embodiment.
Figure 4:
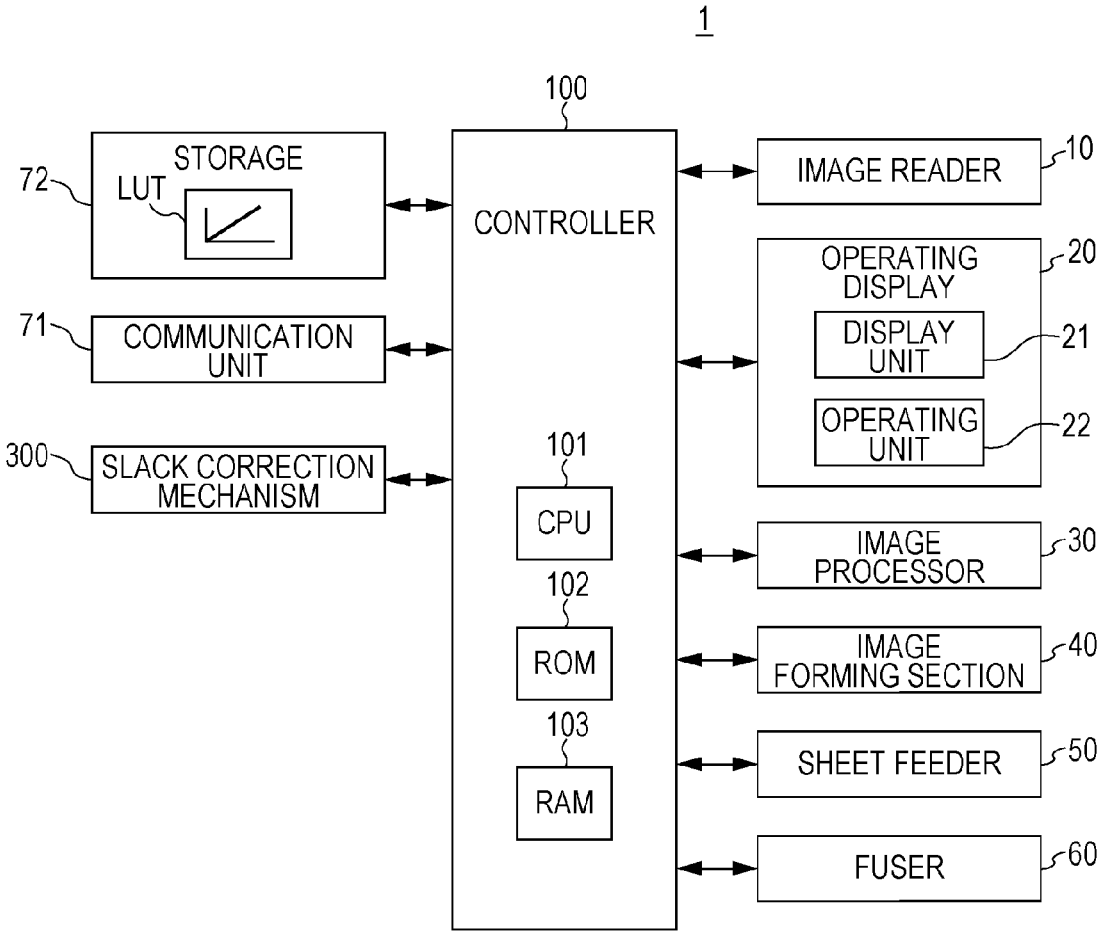
FIG. 4 is a diagram illustrating a main portion of a control system of the image forming apparatus according to the embodiment.

Hereinafter, an embodiment of the present invention will be described in detail with reference to the drawings. However, the scope of the invention is not limited to the illustrated examples. FIG. 3 is a diagram illustrating the entire configuration of an image forming apparatus 1 according to the present embodiment. FIG. 4 is a diagram illustrating a main portion of a control system of the image forming apparatus 1 according to the present embodiment.

The image forming apparatus 1 illustrated in FIGS. 3 and 4 is an intermediate transfer-type color image forming apparatus using electrophotographic process technology. Specifically, the image forming apparatus 1 forms an image by primarily transferring toner images of the respective colors of yellow (Y), magenta (M), cyan (C), and black (K) formed on photoconductor drums 413 to an intermediate transfer belt 421, superimposing the four-color toner images on the intermediate transfer belt 421, and then secondarily transferring them to a sheet S.

The image forming apparatus 1 uses a tandem system in which the photoconductor drums 413 corresponding to the four colors, YMCK, are disposed in series in the direction of travel of the intermediate transfer belt 421, and toner images of the respective colors are sequentially transferred to the intermediate transfer belt 421 in one procedure.

The image forming apparatus 1 includes an image reader 10, an operating display 20, an image processor 30, an image forming section 40, a sheet feeder 50, a fuser 60, a controller 100, and a slack correction mechanism 300. A sheet S corresponds to a "recording medium" in the present invention.

The controller 100 includes a central processing unit (CPU) 101, read-only memory (ROM) 102, and random-access memory (RAM) 103. The CPU 101 reads programs according to processing details from the ROM 102, develops them in the RAM 103, and centrally controls operations of blocks in the image forming apparatus 1 in cooperation with the developed programs. At this time, various kinds of data stored in a storage 72 is referred to. The storage 72 is formed by nonvolatile semiconductor memory (so-called flash memory) or a hard disk drive, for example.

The controller 100 transmits and receives various kinds of data to and from an external device (e.g. a personal computer) connected to a communication network such as a local-area network (LAN) or a wide-area network (WAN), via a communication unit 71. The controller 100 receives image data (input image data) transmitted from an external device, for example, and forms an image on a sheet S based on the image data. The communication unit 71 is formed by a communication control card such as a LAN card, for example.

The image reader 10 includes an automatic document feeder (ADF) 11 and a document image scanner 12 (scanner).

The automatic document feeder 11 feeds documents D placed on a document tray to the document image scanner 12 by a feed mechanism. The automatic document feeder 11 allows images of a number of documents D (including both sides) placed on the document tray to be continuously read at a stroke.

The document image scanner 12 optically scans a document fed onto a contact glass from the automatic document feeder 11 or a document placed on the contact glass, and forms an image of light reflected from the document on a light-receiving surface of a charge-coupled device (CCD) sensor 12*a*, to read the document image. The image reader 10 generates input image data based on the results of reading by the document image scanner 12. The input image data is subjected to predetermined image processing in the image processor 30.

The operating display 20 is formed by a liquid-crystal display (LCD) with a touch panel, for example, and functions as a display unit 21 and an operating unit 22. The display unit 21 displays various operation screens, the state of an image, the operating status of each function, and the like, according to display control signals input from the controller 100. The operating unit 22 includes various operation keys such as a numeric keypad and a start key. The operating unit 22 receives various input operations by a user, and outputs control signals to the controller 100.

The image processor 30 includes a circuit for performing digital image processing on input image data according to initial settings or user settings. For example, the image processor 30 performs tone correction based on tone correction data (a tone correction table) under the control of the controller 100. In addition to tone correction, the image processor 30 performs various types of correction processing such as color correction and shading correction, compression processing, and the like on input image data. The image forming section 40 is controlled, based on image data subjected to these types of processing.

The image forming section 40 includes image forming units 41Y, 41M, 41C, and 41K for forming images with colored toner of a Y component, an M component, a C component, and a K component, based on input image data, an intermediate transfer unit 42, and a secondary transfer unit 90.

The image forming units 41Y, 41M, 41C, and 41K for the Y component, the M component, the C component, and the K component have the same configuration. For illustrative and explanatory convenience, the same components are denoted by the same reference numerals. When they are distinguished, they are denoted by the reference numerals to which Y, M, C, and K are added. In FIG. 3, only the components of the image forming unit 41Y for the Y component are given reference numerals, and reference numerals of the components of the other image forming units 41M, 41C, and 41K are omitted.

Each image forming unit 41 includes an exposure device 411, a developing device 412, a photoconductor drum 413, a charging device 414, and a drum cleaning device 415.

Each photoconductor drum 413 is, for example, a negatively-charged organic photo conductor (OPC) with an under coat layer (UCL), a charge generation layer (CGL), and a charge transport layer (CTL) stacked sequentially on the peripheral surface of an aluminum conductive cylindrical body (aluminum tube stock).

Each charging device 414 generates a corona discharge, thereby negatively charging the surface of the photoconductor drum 413 having photoconductivity uniformly.

Each exposure device 411 is formed, for example, by a semiconductor laser, and emits laser light corresponding to an image of each color component to the photoconductor drum 413. A positive charge is generated in the charge generation layer of each photoconductor drum 413 and transported to the surface of the charge transport layer, thereby to neutralize a surface charge (negative charge) on the photoconductor drum 413. An electrostatic latent image of each color component is formed on the surface of each photoconductor drum 413 due to a potential difference from surrounding areas.

Each developing device 412 is a two-component reversal-type developing device, and causes toner of each color component to adhere to the surface of the photoconductor drum 413, thereby visualizing an electrostatic latent image, forming a toner image. Each developing device 412 supplies toner contained in a developer to the photoconductor drum 413, thereby forming a toner image on the surface of the photoconductor drum 413.

Each drum cleaning device 415 has a drum cleaning blade or the like that slides on the surface of the photoconductor drum 413 to remove untransferred toner remaining on the surface of the photoconductor drum 413 after primary transfer.

The intermediate transfer unit 42 includes an intermediate transfer belt 421, primary transfer rollers 422, a plurality of support rollers 423, and a belt cleaning device 426.

The intermediate transfer belt 421 is formed by an endless belt, and is stretched across the plurality of support rollers 423 in a loop. At least one of the plurality of support rollers 423 is formed by a driving roller, and the others are formed by driven rollers. The rotation of the driving roller causes the intermediate transfer belt 421 to travel in an A direction at a fixed speed.

The intermediate transfer belt 421 is a belt having conductivity and elasticity, and is rotationally driven by control signals from the controller 100.

The primary transfer rollers 422 are disposed on the inner peripheral side of the intermediate transfer belt 421, opposite to the photoconductor drums 413 of the respective color components. The primary transfer rollers 422 are pressed against the photoconductor drums 413 with the intermediate transfer belt 421 therebetween, thereby forming primary transfer nips to transfer toner images from the photoconductor drums 413 to the intermediate transfer belt 421.

The belt cleaning device 426 removes untransferred toner remaining on the surface of the intermediate transfer belt 421 after secondary transfer.

The secondary transfer unit 90 has a secondary transfer roller 91, a downstream roller 92 located downstream of the secondary transfer roller 91 in the direction of feeding a sheet S, and an endless secondary transfer belt 93. The secondary transfer unit 90 corresponds to a "transfer unit" in the present invention.

The secondary transfer roller 91 is disposed on the outer peripheral side of the intermediate transfer belt 421, opposite to a backup roller 423B disposed downstream of a driving roller 423A in the belt travel direction. The drive and stop of the secondary transfer roller 91 are controlled by the controller 100.

The secondary transfer roller 91 is pressed against the backup roller 423B with the intermediate transfer belt 421 and the secondary transfer belt 93 therebetween, thereby forming a secondary transfer nip to transfer a toner image from the intermediate transfer belt 421 to a sheet S. The secondary transfer nip corresponds to a "transfer nip" in the present invention.

When the intermediate transfer belt 421 passes through the primary transfer nips, toner images on the photoconductor drums 413 are primarily transferred to the intermediate transfer belt 421, sequentially superimposed thereon. Specifically, a primary transfer bias is applied to the primary transfer rollers 422 to provide a charge of the polarity opposite to that of the toner to the back side of the intermediate transfer belt 421, that is, the side abutting the primary transfer rollers 422, and thereby to electrostatically transfer toner images to the intermediate transfer belt 421.

Thereafter, when the sheet S passes through the secondary transfer nip, a toner image on the intermediate transfer belt 421 is secondarily transferred to the sheet S. Specifically, a secondary transfer bias is applied to the backup roller 423B by a bias application unit not shown to provide a charge of the same polarity as the toner to the front side of the sheet S, that is, the side abutting the intermediate transfer belt 421, and thereby to electrostatically transfer the toner image to the sheet S. The sheet S to which the toner image has been transferred is transported toward the fuser 60.

The fuser 60 includes an upper fuser 60A having a fused surface-side member disposed on the side of a surface of a sheet S on which a toner image is formed, a fused surface, and a lower fuser 60B having aback surface-side support member disposed on the side of the surface opposite to the fused surface, a back surface of the sheet S. The back surface-side support member is pressed against the fused surface-side member, thereby forming a fuser nip for sandwiching and transporting a sheet S.

The fuser 60 heats and pressurizes by the fuser nip a fed sheet S to which a toner image has been secondarily transferred, thereby fusing the toner image to the sheet S. The fuser 60 is disposed as a unit in a fuser assembly F. In the fuser assembly F, an air separation unit may be disposed for separating a sheet S from the fused surface-side member or the back surface-side support member by blowing air thereon.

The upper fuser 60A has an endless fuser belt 61, a heating roller 62, and a fuser roller 63, fused surface-side members. The fuser belt 61 is stretched by the heating roller 62 and the fuser roller 63 therebetween.

The lower fuser 60B has a pressure roller 64, a back surface-side support member. The pressure roller 64 forms the fuser nip to sandwich a sheet S between the pressure roller 64 and the fuser belt 61 to transport the sheet S. The drive of the pressure roller 64 is controlled by the controller 100 to rotate counterclockwise.

The fuser roller 63 has an outside diameter of 70 mm, and has a rubber layer of silicon rubber with a JISA hardness of 10° and a thickness of 20 mm, and a surface layer of polytetrafluoroethylene. The pressure roller 64 has an outside diameter of 70 mm, and has a rubber layer of silicon rubber with a JISA hardness of 10° and a thickness of 3 mm, and a surface layer of a fluororesin tube. The fuser belt 61 has an outside diameter of 120 mm, and has a substrate of polyimide with a thickness of 70 μm, a rubber layer of silicon rubber with a thickness of 200 μm, and a surface layer of a fluororesin tube. Fusing load is set at 2200 N.

A housing forming the fuser 60 is provided with an upper guide 60C and a lower guide 60D for guiding a sheet to the fuser nip formed by the fuser roller 63 and the pressure roller 64. The lower guide 60D corresponds to a "guide" in the present invention.

The lower guide 60D is inclined at an angle of 35° with respect to a horizontal direction, and the length of an inclined portion is set at 50 mm, for example. A loop amount detector not shown is provided at the lower guide 60D. The fusing speed of the fuser 60 is controlled based on a detection result detected by the loop amount detector.

A slack correction mechanism 300 for correcting slack in a sheet in the feed direction is provided upstream of the fuser 60 in the feed direction. The slack correction mechanism 300 and the controller 100 correspond to a "pressing unit" in the present invention.

The sheet feeder 50 includes a paper feed unit 51, a paper discharge unit 52, and a feed path 53. In three paper feed tray units 51*a* to 51*c* constituting the paper feed unit 51, sheets S (standard sheets and special sheets) identified based on basis weights, sizes, or the like are held by predetermined types. The feed path 53 has a plurality of feed roller pairs such as resist roller pairs 53*a*.

The sheets S held in the paper feed tray units 51*a* to 51*c* are sent out one by one from the top, and fed to the image forming section 40 through the feed path 53. At this time, a resist roller unit in which the resist roller pairs 53*a* are provided corrects the inclination of a fed sheet S, and adjusts feed timing. Then, in the image forming section 40, toner images on the intermediate transfer belt 421 are collectively secondarily transferred to one side of the sheet S, and subjected to a fusing process in the fuser 60. The sheet S on which an image has been formed is discharged to the outside of the machine by the paper discharge unit 52 having paper discharge rollers 52*a*.

Figure 1A:
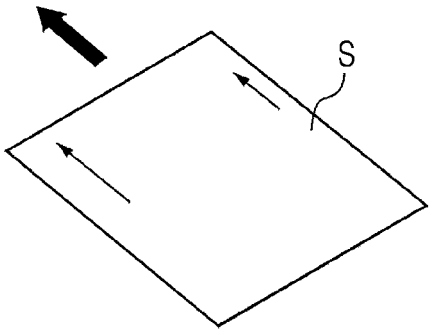
FIGS. 1A and 1B are perspective views illustrating a sheet when a difference in feed state arises between its both edge portions in a width direction.
Figure 1B:
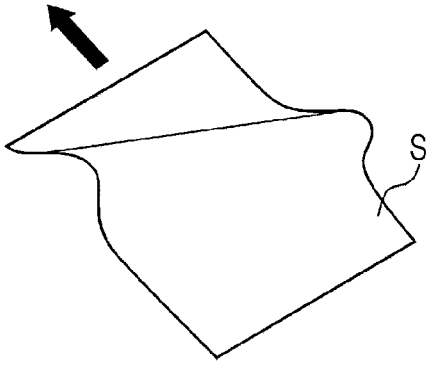
Figure 2:
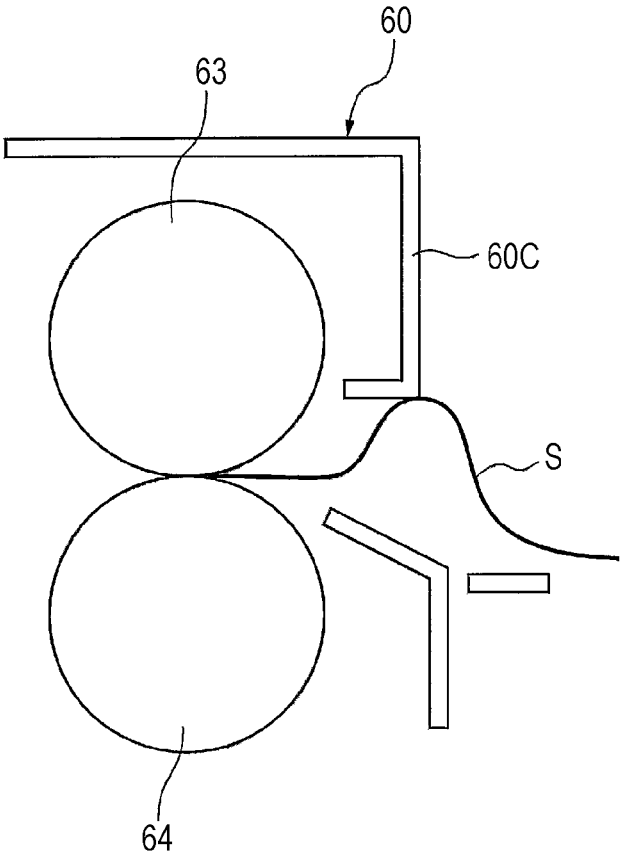
FIG. 2 is a diagram illustrating a state where a sheet having increased slack in a feed direction contacts a peripheral member.

When a difference in feed state arises in the sheet S in the width direction as illustrated in FIGS. 1A and 1B, slack occurs in the sheet S in the feed direction. When the slack in the sheet S in the feed direction becomes too large, the sheet S contacts a peripheral member such as the upper guide 60C of the housing forming the fuser 60. The upper surface of the sheet S, which is an unfused image forming surface, contacts the upper guide 60C, causing an image defect.

Figure 5:
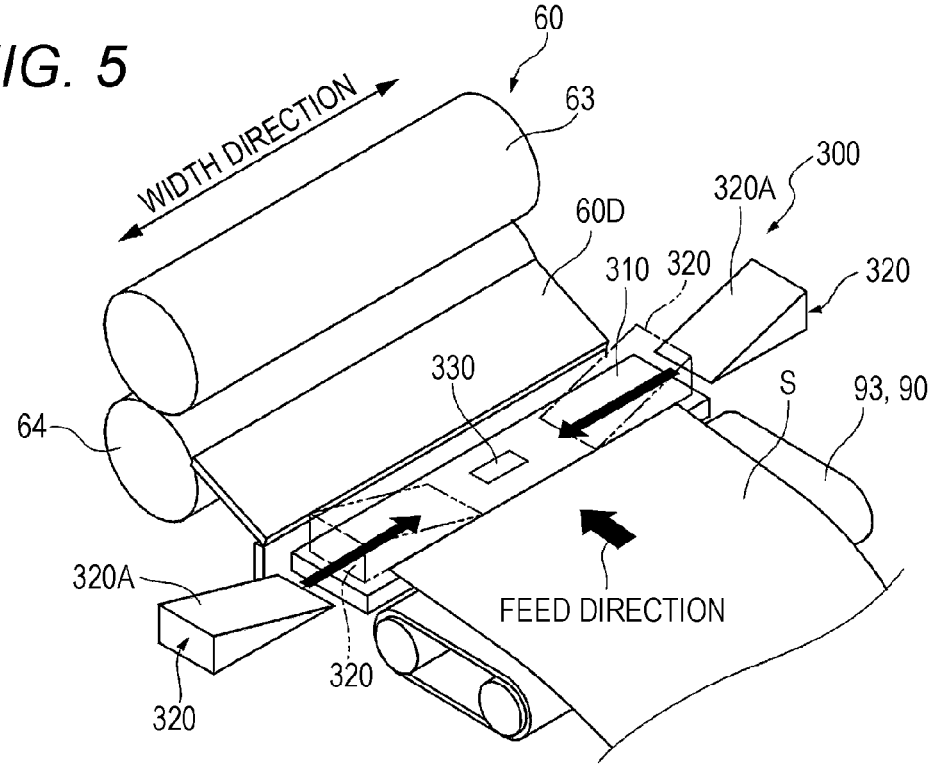
FIG. 5 is a perspective view illustrating a slack correction mechanism.

Thus, in the present embodiment, the slack correction mechanism 300 performs slack correction control to correct slack in a sheet in the feed direction. This can prevent slack in a sheet in the feed direction caused by a difference in feed state arising in the sheet in the width direction. Hereinafter, details of the slack correction mechanism 300 will be described. FIG. 5 is a perspective view illustrating the slack correction mechanism 300. In FIG. 5 and thereafter, the fuser belt 61 and the heating roller 62 in the fuser 60 are not shown.

As illustrated in FIG. 5, the slack correction mechanism 300 is disposed between the secondary transfer unit 90 and the fuser 60, and includes a fixed portion 310 and a pair of movable portions 320. The movable portions 320 correspond to "movable members" in the present invention.

The fixed portion 310 is formed in a plate shape elongated in the width direction of a sheet S. The fixed portion 310 is disposed upstream of the lower guide 60D in the feed direction, and guides a sheet S to the lower guide 60D. A detector 330 is disposed at the center of the fixed portion 310 in the width direction. The detector 330 detects a sheet S passing over the fixed portion 310, and outputs a detection result to the controller 100.

The pair of movable portions 320 are provided on both sides of the fixed portion 310 in the width direction, and are formed in a triangular pole shape. Each movable portion 320 has a surface facing the sheet S side, inclined to be located in an upper position (in the direction from the back to the front of the sheet S) toward the outside in the width direction, constituting an inclined surface 320A. Each movable portion 320 is formed in a shape with a height of 30 mm, a length of 30 mm in the feed direction, and a length of 50 mm in the width direction, for example.

The movable portions 320 are configured to be movable, under the control of the controller 100, between non-correcting positions (solid line positions) located outside of the fixed portion 310 in the width direction and correcting positions (chain double-dashed line positions) located within the fixed portion 310. The movable portions 320, when located in the non-correcting positions, are out of a feed path of a sheet S, and do not contact the sheet S. The movable portions 320, when located in the correcting positions, enter the feed path of a sheet S, and contact the back side of the sheet S.

Here, an operation of the movable portions 320 will be described.

Figure 6:
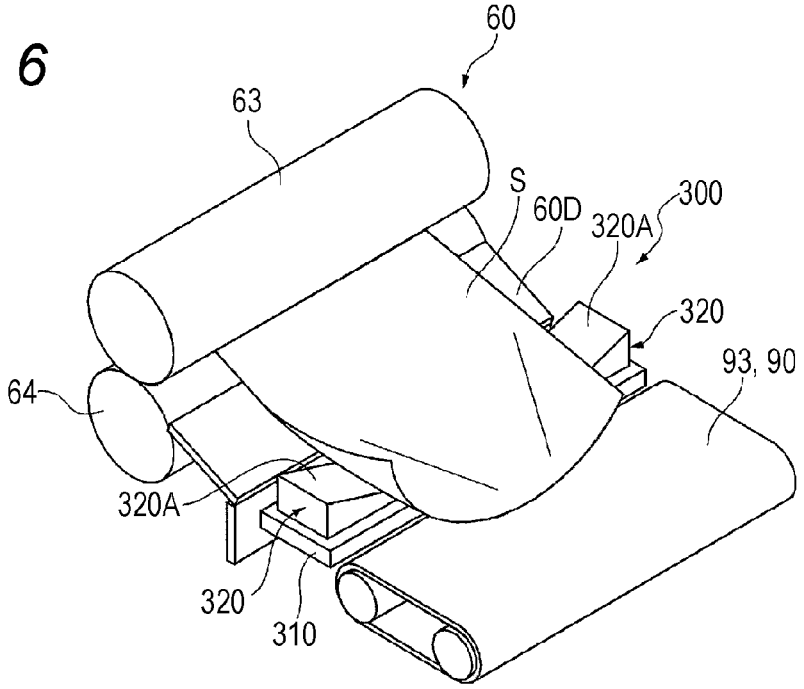
FIG. 6 is a perspective view illustrating the slack correction mechanism when slack in a sheet is corrected by movable portions.

Before a sheet S is fed, the movable portions 320 are located in the non-correcting positions. When a sheet S is fed and the front end of the sheet S is detected by the detector 330, the controller 100 causes the movable portions 320 to move to the correcting positions. Since the sheet S-side surfaces of the movable portions 320 constitute the inclined surfaces 320A, the inside ends of the inclined surfaces 320A smoothly enter into the underside of the sheet S. As illustrated in FIG. 6, by the movable portions 320 entering into the underside of the sheet S, both edge portions on the back side of the sheet S in the width direction are pressed by the inclined surfaces 320A of the movable portions 320. By the both edge portions on the back side of the sheet S being pressed by the movable portions 320, the both edge portions of the sheet S are deformed to a shape in conformity with the inclined surfaces 320A, and a central portion of the sheet S in the width direction becomes lower than the both edge portions in the width direction. When slack occurs in the sheet S in the feed direction, this deformation allows the slack in the feed direction to be corrected by the movable portions 320 that convert the slack into slack in the width direction. This can prevent slack in the feed direction from increasing to cause the sheet S to contact a peripheral member such as the upper guide 60C of the fuser 60. Further, by the sheet S slacking in the width direction, the central portion of the sheet S constituting an image forming area portion comes below edges outside an image forming area, so that the image forming area portion is less likely to contact a peripheral member, and thus image defects can be prevented.

Figure 7:
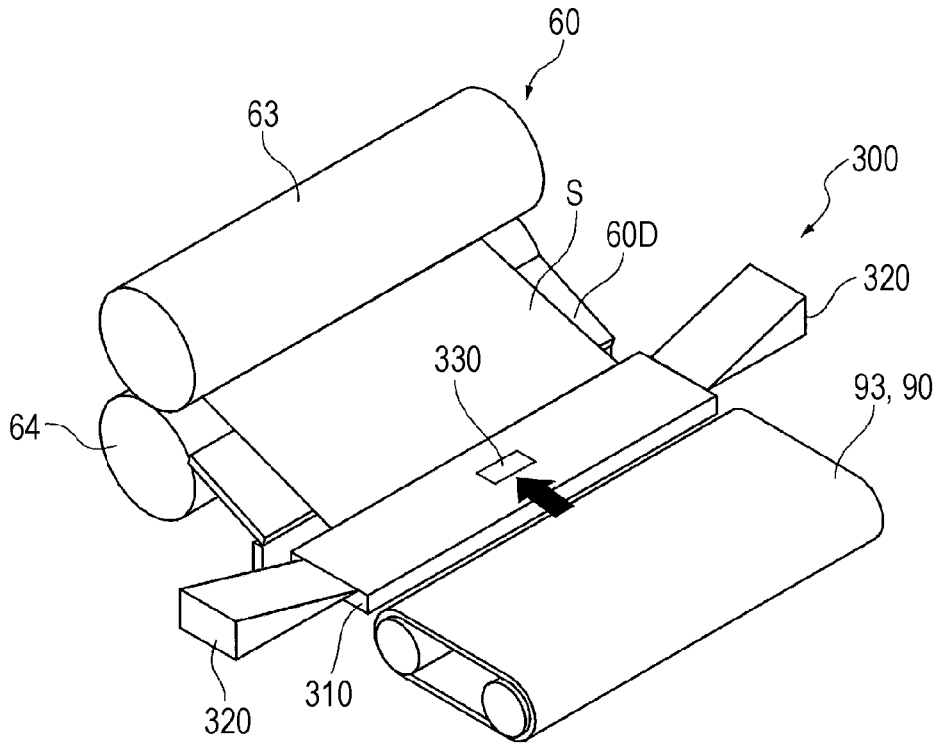
FIG. 7 is a perspective view illustrating the slack correction mechanism after a sheet has passed over the positions of the movable portions.

As illustrated in FIG. 7, when the sheet S passes over the positions of the movable portions 320, the movable portions 320 move to the non-correcting positions under the control of the controller 100. In other words, the movable portions 320 are moved to the non-correcting positions by the controller 100 after the rear end of the sheet S passes over the position of the fixed portion 310 and before the front end of the next sheet S reaches the position of the fixed portion 310. Here, if the movable portions 320 have been located in the correcting positions before the sheet S reaches the position of the fixed portion 310, the front end of the sheet S can strike the movable portions 320, causing problems such as corner bending and a jam of the sheet S. Therefore, when the sheet S is not on the fixed portion 310, the movable portions 320 are located in the non-correcting positions not to contact the sheet S, that is, not to correct slack in the sheet S. This can prevent the front end of the sheet S from striking the movable portions 320.

Figure 8:
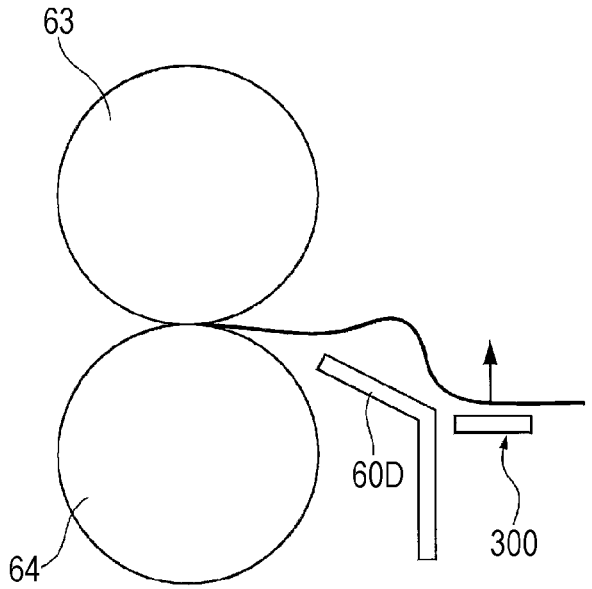
FIG. 8 is a diagram illustrating a sheet transported between a fuser nip and a transfer nip.

A configuration in which a guide member in the immediate vicinity of the fuser nip such as the lower guide 60D is moved, for example, causes unstable entry of a sheet S into the fuser nip. The unstable entry of the sheet S into the fuser nip causes problems that a wrinkle occurs in the sheet S, and the sheet S comes close to the fuser roller 63 at the front of the fuser nip, causing uneven brightness. In the present embodiment, however, slack in a sheet S is corrected by the slack correction mechanism 300 located upstream of the lower guide 60D in the feed direction, that is, in a position away from the fuser nip. Therefore, as illustrated in FIG. 8, since a sheet S is moved at a position away from the fuser nip, and is not changed in shape before and after deformation at a position in the immediate vicinity of the fuser nip, the entry of the sheet S into the fuser nip can be stabilized.

Slack in a sheet in the feed direction is likely to occur in a sheet with low sheet stiffness and a small basis weight and in a long sheet elongated in the feed direction. Thus, the controller 100 performs control to change the movable amount of the movable portions 320 according to the types of sheets. For example, for sheets with a large basis weight (e.g. sheets of a basis weight of 136 to 350 g/m$^2$), slack correction control itself is not performed because slack in the feed direction is unlikely to occur. For sheets of other basis weights (e.g. sheets of a basis weight of less than 135 g/m$^2$), the movable amount of the movable portions 320 is changed according to the length in the feed direction and the basis weight. This control can prevent needless control, and can provide a proper amount of deformation of a sheet S.

The controller 100 may perform slack correction control by reading, from the storage 182 or the like, tables as illustrated in tables below showing movable positions of the movable portions 320 associated with the length in the feed direction and the length in the width direction of sheets by basis weight. Table 1 illustrates the movable positions of the movable portions 320 associated with the length in the feed direction and the length in the width direction of sheets of a basis weight of 55 to 80 g/m$^2$. Table 2 illustrates the movable positions of the movable portions 320 associated with the length in the feed direction and the length in the width direction of sheets of a basis weight of 81 to 105 g/m$^2$. Table 3 illustrates the movable positions of the movable portions 320 associated with the length in the feed direction and the length in the width direction of sheets of a basis weight of 106 to 135 g/m$^2$. Table 4 illustrates the movable position of the movable portions 320 associated with the length in the feed direction and the length in the width direction of sheets of a basis weight of 136 to 350 g/m$^2$. The movable position of each movable portion 320 is a distance from the center position between the pair of movable portions 320 to the front end of the movable portion 320. The unit of the movable position of the movable portions 320 in Tables 1 to 4 is "mm." "Not Moved" in Tables 1 to 4 means that the movable portions 320 are not moved.

TABLE 1

| | | Feed Direction Length (mm) | | |
|---|---|---|---|---|
| 55 to 80 g/m$^2$ | | 0 to 209 | 210 to 488 | 489 to 1200 |
| Width | 0 to 209 | Not Moved | Not Moved | Not Moved |
| Direction | 210 to 296 | Not Moved | 105 | 105 |
| Length (mm) | 297 to 330 | Not Moved | 105 | 95 |

TABLE 2

| | | Feed Direction Length (mm) | | |
|---|---|---|---|---|
| 81 to 105 g/m$^2$ | | 0 to 209 | 210 to 488 | 489 to 1200 |
| Width | 0 to 209 | Not Moved | Not Moved | Not Moved |
| Direction | 210 to 296 | Not Moved | 115 | 115 |
| Length (mm) | 297 to 330 | Not Moved | 115 | 105 |

TABLE 3

| | | Feed Direction Length (mm) | | |
|---|---|---|---|---|
| 106 to 135 g/m$^2$ | | 0 to 209 | 210 to 488 | 489 to 1200 |
| Width | 0 to 209 | Not Moved | Not Moved | Not Moved |
| Direction | 210 to 296 | Not Moved | 125 | 125 |
| Length (mm) | 297 to 330 | Not Moved | 125 | 115 |

TABLE 4

| | | Feed Direction Length (mm) | | |
|---|---|---|---|---|
| 136 to 350 g/m$^2$ | | 0 to 209 | 210 to 488 | 489 to 1200 |
| Width | 0 to 209 | Not Moved | Not Moved | Not Moved |
| Direction | 210 to 296 | Not Moved | Not Moved | Not Moved |
| Length (mm) | 297 to 330 | Not Moved | Not Moved | Not Moved |

Figure 9:
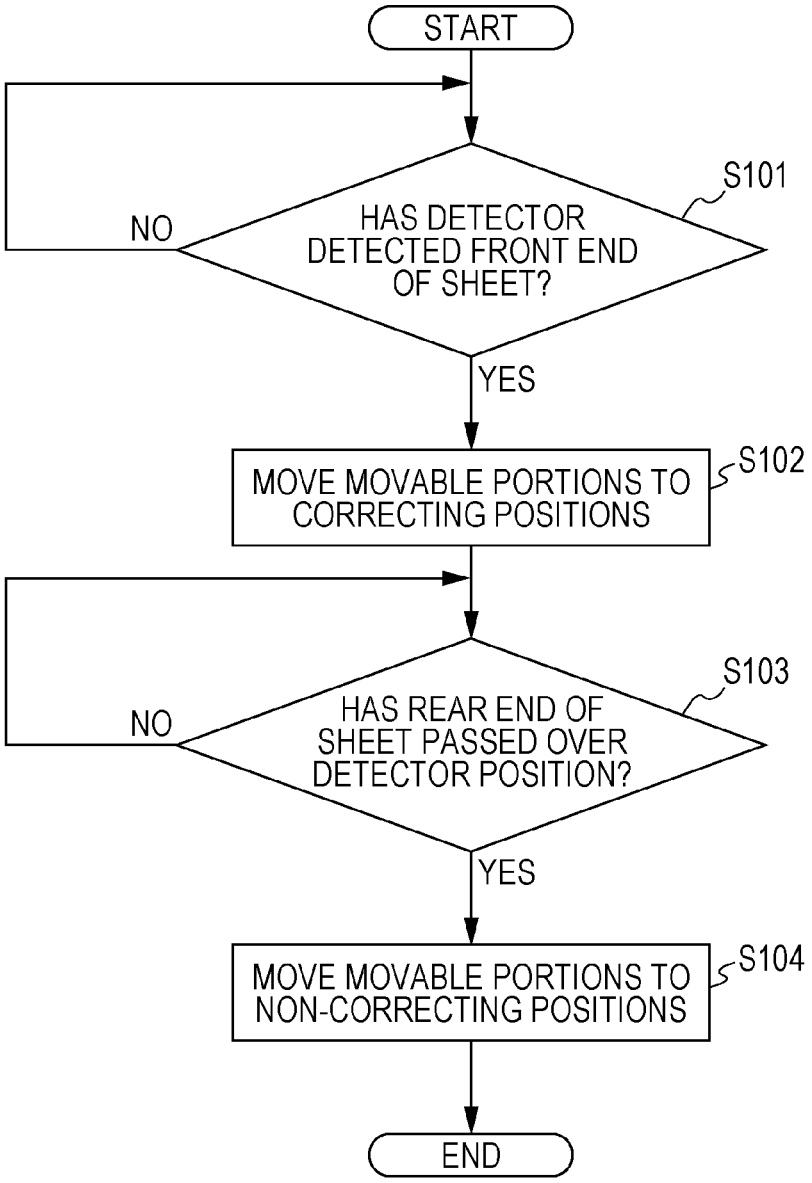
FIG. 9 is a flowchart illustrating an example of an operation example when slack correction control is performed in the image forming apparatus.

Next, an operation example when slack correction control is performed in the image forming apparatus 1 will be described. FIG. 9 is a flowchart illustrating an example of the operation example when slack correction control is performed in the image forming apparatus 1. Processing in FIG. 9 is performed when the type of sheets in a print job is a type for which the movable portions 320 are moved, for example.

As illustrated in FIG. 9, the controller 100 determines whether the front end of a sheet has been detected by the detector 330 or not (step S101). When the result of the determination shows that the detector 330 has not detected the front end of a sheet (NO in step S101), processing in step S101 is repeated. On the other hand, when the detector 330 has detected the front end of a sheet (YES in step S101), the controller 100 moves the movable portions 320 to the correcting positions corresponding to a movable amount depending on the type of the sheet (step S102).

Next, the controller 100 determines whether the detector 330 has detected the rear end of the sheet or not (step S103). When the result of the determination shows that the detector 330 has not detected the rear end of the sheet (NO in step S103), processing in step S103 is repeated. On the other hand, when the detector 330 has detected the rear end of the sheet (YES in step S103), the controller 100 moves the movable portions 320 to the non-correcting positions (step S104) to complete the control.

The image forming apparatus 1 configured as above deforms a sheet S at a timing after the front end of the sheet S has passed over the positions of the movable portions 320 in the feed direction, and thus can correct slack in the sheet S in the feed direction that has occurred due to a difference in feed state arising in the width direction of the sheet S. Therefore, when slack in a sheet S in the feed direction is increased, the image forming surface can be prevented from contacting a peripheral member such as the upper guide 60C, and thus occurrence of image defects can be prevented.

When no sheet S has been fed, the movable portions 320 are located in the non-correcting positions, and thus can prevent the front end of a sheet S fed from striking the movable portions 320.

Since the movable portions 320 are located upstream of the lower guide 60D in the feed direction, a sheet S is deformed without moving the lower guide 60D in the immediate vicinity of the fuser nip. Therefore, the entry of the sheet S into the fuser nip can be stabilized, compared to a configuration in which a guide member in the immediate vicinity of a fuser nip moves.

Since the sheet S-feed surfaces of the movable portions 320 constitute the inclined surfaces 320A, the movable portions 320 are enabled to easily enter into the underside of a sheet S when they are moved to the correcting positions.

Further, since the amount of correction of a sheet S at the movable portions 320 is controlled according to the type of the sheet S, needless control can be prevented, and the amount of deformation of the sheet S can be made proper.

Figure 10:
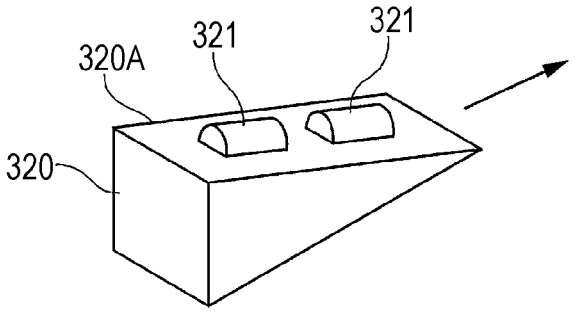
FIG. 10 is a diagram illustrating a movable portion according to a first modification.

Although a sheet S is fed over the inclined surfaces 320A of the movable portions 320 in the above embodiment, the inclined surfaces 320A may be configured to be provided with rollers 321 (rotating bodies) as illustrated in FIG. 10 to allow a sheet S to be fed while in contact with the rollers 321. This configuration reduces frictional force in the feed of a sheet S by the rollers 321 rotating as the sheet S is fed, and thus can smooth the feed of the sheet S. Further, during double-sided printing, the movable portions 320 can be prevented from contacting an image on the back side, making a contact flaw. For the material of the rollers 321, for example, those made of resin may be used.

Figure 11:
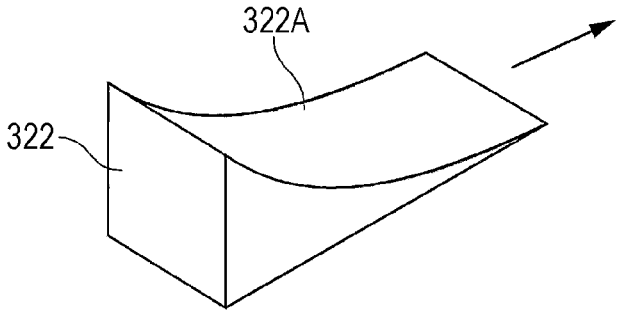
FIG. 11 is a diagram illustrating a movable portion according to a second modification.

Although the movable portions 320 are configured to have the inclined surfaces 320A in the above embodiment, the present invention is not limited to this. For example, as illustrated in FIG. 11, each movable portion 322 may be configured to have a curved surface 322A curved to be located in an upper position toward the outside in the width direction. By making the curved surfaces 322A lower than the inclined surfaces 320A in the above embodiment, the movable portions 322 are enabled to easily enter into the underside of a sheet S when the movable portions 322 are moved to the correcting positions.

Figure 12:
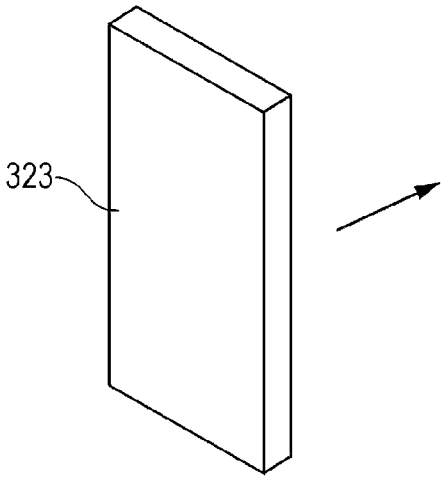
FIG. 12 is a diagram illustrating a movable portion according to a third modification.

For another example, as illustrated in FIG. 12, each movable portion 323 may be configured to be formed in a plate shape. The movable portions 323 are disposed in a vertical position, and press side edge faces of a sheet S by moving in the width direction. A sheet S pressed at the side edge faces deforms so that both edge portions are lower than a central portion, or the both edge portions are upper than the central portion. Considering that the image forming surface of a sheet S should be prevented from contacting a peripheral member, it is desirable to cause the movable portions 323 to press so that both edge portions are upper than a central portion.

In the configuration in FIG. 12, the movable portion 323 may be configured to be rotated with the upper end of the movable portion 323 as a center of rotation. This configuration causes the movable portion 323 to rotate so that a lower end portion of the movable portion 323 presses an edge portion of a sheet S. When slack occurs in a sheet S in the feed direction, this can correct the slack in the sheet S.

Figure 13:
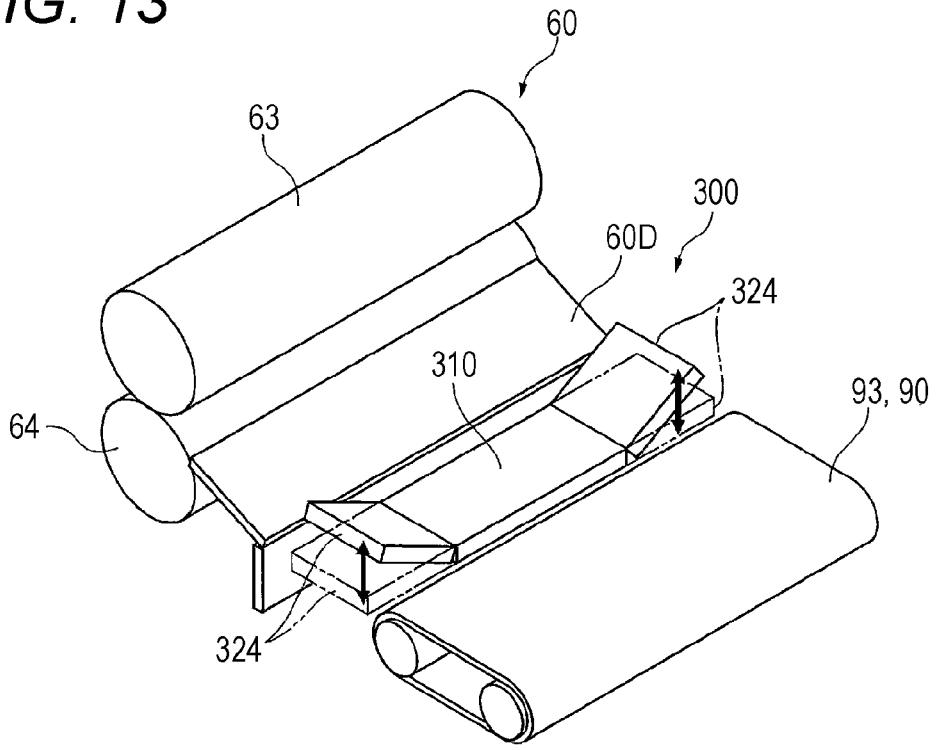
FIG. 13 is a perspective view illustrating a slack correction mechanism according to a fourth modification.

A configuration in which movable portions are rotated may be a configuration as illustrated in FIG. 13 in which movable portions 324 formed in a plate shape are disposed in a horizontal position. In this configuration, the movable portions 324 are disposed on both sides of the fixed portion 310 in the width direction, and rotate with their ends on the fixed portion 310 side in the width direction as a center of rotation, thereby moving between non-correcting positions (chain double-dashed line positions) and correcting positions (solid line positions). The movable portions 324 press both edge portions of a sheet S to deform the sheet S when the movable portions 324 are located in the correcting positions. When slack occurs in a sheet S in the feed direction, this configuration can also correct the slack in the sheet S.

Figure 14:
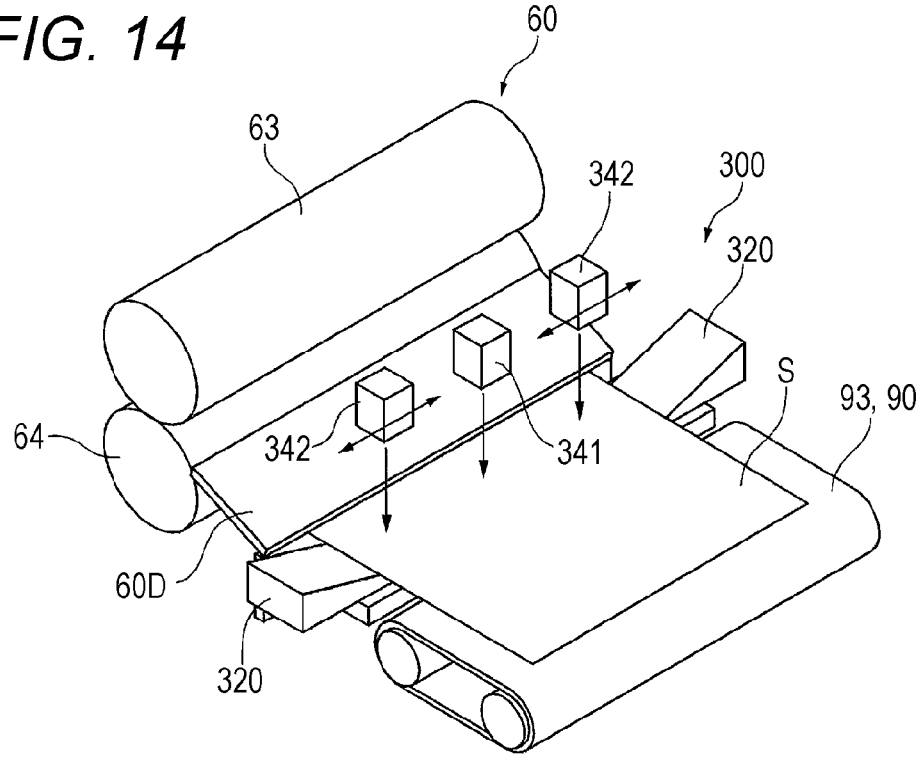
FIG. 14 is a perspective view illustrating a slack correction mechanism provided with slack detectors.

Although in the above embodiment, the presence or absence of slack in a sheet S in the feed direction is not determined, the present invention is not limited to this. As illustrated in FIG. 14, control may be performed to determine the presence or absence of slack in the sheet S in the feed direction.

The slack correction mechanism 300 in this configuration has a first slack detector 341 and second slack detectors 342 for detecting the amounts of slack in a sheet S in the feed direction. The first slack detector 341 and the second slack detectors 342 correspond to a "slack detector" in the present invention.

For example, the first slack detector 341 and the second slack detectors 342 are sensors that measure distance from a sheet S to detect the amounts of slack in the sheet S in the feed direction, and are provided in positions above a fed sheet S, opposite to the sheet S.

The first slack detector 341 is provided in a position opposite to a central portion of a sheet S in the width direction. The second slack detectors 342 are each provided in a position opposite to one of both edge portions of a sheet S in the width direction. The second slack detectors 342 are movable in the width direction, and move to the positions of both edge portions of a sheet S in the width direction under the control of the controller 100. The positions of the second slack detectors 342 in the width direction are determined based on the width of a sheet S.

Based on detection results detected by the first slack detector 341 and the second slack detectors 342, the controller 100 determines whether to correct slack in the sheet S in the feed direction or not. This can prevent needless slack correction control since slack correction control is not performed when no slack occurs in a sheet S in the feed direction.

The controller 100 also controls the movable amounts of the movable portions 320 to control the amount of deformation of each of both edge portions of a sheet S in the width direction, according to detection results detected by the two second slack detectors 342. Specifically, the controller 100 moves the two second slack detectors 342 individually to the positions of both edge portions of a sheet S in the width direction, to adjust the movable amounts of the movable portions 320 according to the detected amounts detected by the first slack detector 341 and the second slack detectors 342. The movable amounts of the movable portions 320 are determined based on the detected amounts detected by the first slack detector 341 and the second slack detectors 342, that is, the amounts of slack in the sheet S. The amounts of slack in the sheet S can be calculated, for example, by subtracting the detected amounts detected by the second slack detectors 342 from the detected amount detected by the first slack detector 341. This can make the amounts of deformation of the both edge portions of the sheet S in the width direction uniform, and enables proper slack correction control according to the amounts of slack in the sheet S.

Although in the above embodiment, slack correction control is performed at a timing after the front end of a sheet S has passed over according to the detector 330, the present invention is not limited to this. For example, slack correction control may be performed at a timing when the front end of a sheet S enters the fuser nip.

Although in the above embodiment, the positions of the movable portions 320 are returned to the non-correcting positions at a timing when the rear end of a sheet S has passed over the position of the detector 330, the present invention is not limited to this. For example, when it is possible to determined that slack in a sheet S in the feed direction has been corrected based on detection results detected by the slack detector or the like, the positions of the movable portions 320 may be returned to the non-correcting positions before the rear end of a sheet S passes over the position of the detector 330.

Although in the above embodiment, the color image forming apparatus is illustrated, a monochrome image forming apparatus may be used.

The present invention is applicable to image forming systems formed by a plurality of units including an image forming apparatus. The plurality of units includes external devices such as a postprocessor and a network-connected controller.

Although the present invention has been described and illustrated in detail, it is clearly understood that the same is by way of illustrated and example only and is not to be taken by way of limitation, the scope of the present invention being interpreted by terms of the appended claims. That is, the present invention can be implemented in various forms without departing from its scope or its major features.

What is claimed is:

1. An image forming apparatus comprising:

a transfer unit configured to transfer a toner image to a recording medium at a transfer nip;

a fuser unit configured to heat and pressurize at a fuser nip the recording medium to which the toner image has been transferred by the transfer unit, to fuse the toner image to the recording medium; and a pressing unit configured to press both edge portions of the recording medium in a width direction between the transfer nip and the fuser nip so that a central portion of the recording medium in the width direction becomes lower than the both edge portions of the recording medium in the width direction.

2. The image forming apparatus according to claim 1, wherein the pressing unit comprises:

a slack correction mechanism including a fixed portion and movable members configured to move relative to the fixed portion; and a controller configured to control movement of the movable members, wherein the movable members are movable with respect to the recording medium, and press the both edge portions of the recording medium in the width direction.

3. The image forming apparatus according to claim 2, wherein the pressing unit moves the movable members at a timing after a front end of the recording medium has passed over positions of the movable members in a feed direction of the recording medium.

4. The image forming apparatus according to claim 2, further comprising:

a guide located between the fuser nip and the movable members in the feed direction of the recording medium, the guide being configured to guide the recording medium to the fuser nip.

5. The image forming apparatus according to claim 2, further comprising:

a detector disposed in a position of the movable members in a feed direction of the recording medium, the detector being configured to detect passing of the recording medium over the position, wherein the movable members are movable between correcting positions to correct slack in the recording medium in the feed direction, and non-correcting positions not to correct slack in the recording medium in the feed direction, and the pressing unit, after moving the movable members from the non-correcting positions to the correcting positions based on a detection result detected by the detector, returns the movable members to the non-correcting positions before a recording medium subsequent to the recording medium reaches the position of the detector.

6. The image forming apparatus according to claim 5, wherein the movable members are provided on both sides of the recording medium in the width direction, and move in the width direction to press a back side of the recording medium, and the movable members have a pressing surface inclined to be higher from inside in the width direction to outside in the width direction.

7. The image forming apparatus according to claim 2, wherein the pressing unit controls a movable amount of the movable members according to a type of the recording medium.

8. The image forming apparatus according to claim 7, wherein the pressing unit increases the movable amount of the movable members as length of the recording medium in a feed direction increases.

9. The image forming apparatus according to claim 7, wherein the pressing unit increases the movable amount of the movable members as basis weight of the recording medium decreases.

10. The image forming apparatus according to claim 2, wherein the slack detector is configured to detect an amount of slack in the recording medium in a feed direction, and the pressing unit determines whether to correct slack in the recording medium in the feed direction or not based on a detection result detected by the slack detector.

11. The image forming apparatus according to claim 10, wherein the pressing unit controls movable amounts of the movable members to control an amount of deformation of each of the both edge portions of the recording medium, according to detection results detected by the slack detector.

12. The image forming apparatus according to claim 10, wherein the slack detector has a first slack detector configured to detect an amount of slack in the feed direction in the central portion of the recording medium in the width direction, and second slack detectors configured to detect an amount of slack in the feed direction in at least one edge portion of the both edge portions of the recording medium in the width direction, the second slack detectors being movable in the width direction, and the pressing unit moves the second slack detectors to positions of the both edge portions of the recording medium in the width direction.

13. The image forming apparatus according to claim 2, wherein the movable members have a rotating body that contacts the recording medium.

14. The image forming apparatus according to claim 13, wherein the rotating body is a roller.

15. A feed control method for an image forming apparatus comprising a transfer unit configured to transfer a toner image to a recording medium at a transfer nip, and a fuser unit configured to heat and pressurize at a fuser nip the recording medium to which the toner image has been transferred by the transfer unit, to fuse the toner image to the recording medium, the method comprising:

using a pressing unit to press both edge portions of the recording medium in a width direction between the transfer nip and the fuser nip so that a central portion of the recording medium in the width direction becomes lower than the both edge portions of the recording medium in the width direction.

* * * * *